US006382262B1

(12) United States Patent
Herzig

(10) Patent No.: US 6,382,262 B1
(45) Date of Patent: May 7, 2002

(54) APPARATUS FOR FORMING A LENO WEAVE

(75) Inventor: Marcel Herzig, Winterthur (CH)

(73) Assignee: Sulzer Textil AG, Joweid Zentrum (CH)

( * ) Notice: Subject to any disclaimer, the term of this patent is extended or adjusted under 35 U.S.C. 154(b) by 0 days.

(21) Appl. No.: 09/715,577

(22) Filed: Nov. 16, 2000

(30) Foreign Application Priority Data

Nov. 16, 1999 (EP) ..... 99 811 051

(51) Int. Cl.[7] ..... D03C 7/00
(52) U.S. Cl. ..... 139/50
(58) Field of Search ..... 139/50, 54

(56) References Cited

U.S. PATENT DOCUMENTS 5,123,454 A * 6/1992 Debaes ..... 139/54
6,009,917 A * 1/2000 Meyns et al. ..... 139/54
6,092,559 A * 7/2000 Dvorak et al. ..... 139/54

FOREIGN PATENT DOCUMENTS

| | | |
|---|---|---|
| DE | 466340 | 10/1928 |
| DE | 810614 | 8/1951 |
| DE | 2108685 | 8/1972 |
| DE | 2442914 | 9/1975 |
| EP | 0450120 A1 | 10/1991 |
| FR | 1411838 | 12/1965 |
| WO | WO 98/07913 | 2/1998 |

* cited by examiner

*Primary Examiner*—Andy Falik
(74) *Attorney, Agent, or Firm*—Townsend and Townsend and Crew LLP

(57) ABSTRACT

Apparatus for forming a leno weave from a leno thread and a ground thread. The apparatus includes a reed for guiding the leno thread and the ground thread, and a needle bar with ground thread needles for guiding the ground thread. The needle bar also includes a movably mounted leno thread displacing apparatus, with the needle bar and the leno thread displacing apparatus being arranged ahead of the reed. The leno thread displacing apparatus includes a laying element that is displaceably mounted in a displacement direction that extends substantially parallel to the direction of extent for the reed. The laying element includes guiding apparatus for guiding the leno thread. The leno thread displacing apparatus is movably mounted in a direction of movement that extends transversely to the direction of extent of the reed, in particular, in a substantially vertically extending direction, in order to move the leno thread both in the displacement direction and in the direction of movement.

13 Claims, 7 Drawing Sheets

APPARATUS FOR FORMING A LENO WEAVE

BACKGROUND OF THE INVENTION

1. Field of the Invention

The invention relates to an apparatus for forming a leno weave.

2. Description of the Prior Art

An apparatus for forming a leno weave is known from the specification WO 98/07913. In addition to a ground thread needle bar, which is providede for holding the ground thread, this apparatus comprises three further head frames for holding the leno thread. A first frame contains a longitudinal rail with small, obliquely extending slits for receiving the leno thread. A further frame contains a longitudinal rail with a groove which extends over the entire cloth width for guiding all leno threads. The third frame has a pivotal arrangement in order to tension the leno threads so that the leno threads move in the oblique slits of the first frame in the direction of the cloth width. Disadvantageous in this known arrangement is that the apparatus is relatively expensive.

SUMMARY OF THE INVENTION

The object of the present invention is to propose an economically more advantageous apparatus for forming a leno weave.

The object is satisfied in particular by an apparatus for forming a leno weave from a leno thread and a ground thread comprising a reed for guiding the leno thread and the ground thread, a needle bar with ground thread needles for guiding the ground thread and a movably mounted leno thread displacing apparatus, with the needle bar and the leno thread displacing apparatus being arranged ahead of the reed, with the leno thread displacing apparatus comprising a laying element which is displaceably mounted in a direction of displacement which extends substantially parallel to the direction of extent of the reed, and with the laying element having guiding means for guiding the leno thread, and with the leno thread displacing apparatus being movably mounted in a direction of movement which extends transversely to the direction of extent of the reed, in particular in a substantially vertically extending direction, in order to move the leno thread both in the displacement direction and in the direction of movement.

The apparatus in accordance with the invention thus has a leno thread displacing apparatus which guides the leno thread both in the direction of movement, which preferably extends substantially vertically, and in the direction of the cloth width or in the direction of extent of the reed respectively in order to move the leno thread in a controllable manner and in particular to dip the latter into the intermediate spaces of the needle bar which are formed by the ground thread needles and to remove them again. The apparatus in accordance with the invention permits the leno threads to be moved extremely precisely, and is in addition relatively low in mass and thus permits a rapid and faultless weaving of a leno cloth. In addition the apparatus in accordance with the invention can be manufactured economically.

In an advantageous embodiment both the leno thread displacing apparatus and the ground thread needle bar are displaceably mounted, which has the advantage that the shed which is formed by the ground threads and leno threads can be produced even more rapidly or with a smaller stroke movement respectively. Through this measure a further increase in the weaving speed is possible.

In an advantageous embodiment ground thread needles for ground threads and/or laying elements with guiding means for the leno threads are arranged over the entire cloth width in order to produce a cloth which has only a single leno weave over its entire width. With an apparatus of this kind a cloth can also be produced which has a leno weave over one or more partial sections of the cloth width, whereas the warp threads of the remaining partial sections have another binding.

The apparatus in accordance with the invention can be operated in combination with weaving machines of different types, thus for example with air jet weaving machines, with rapier weaving machines or with projectile weaving machines.

DETAILED DESCRIPTION OF SPECIFIC EXEMPLARY EMBODIMENTS

Figure 1:
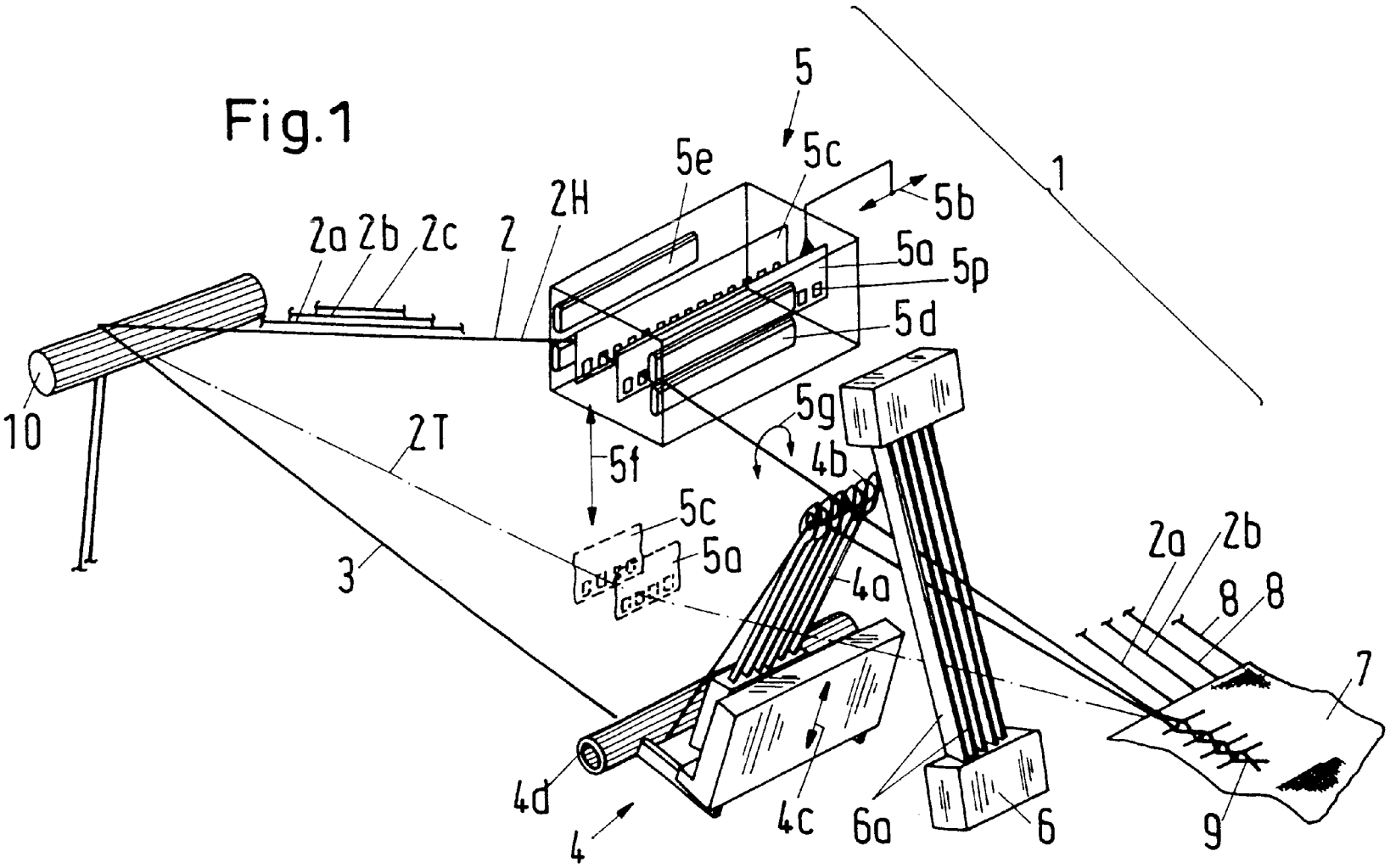
FIG. 1 is a three-dimensional view of an apparatus for forming a leno edge.

FIG. 1 shows the apparatus 1 for forming a leno weave, which comprises substantially the ground thread needle bar 4 and the leno thread displacing apparatus 5. The ground thread needle bar 4 has ground thread needles 4*a* with ground thread needle eyes 4*b* which are arranged with spacing in the direction of the cloth width. In addition the illustrated ground thread needle bar 4 has a deflection element 4*d* for ground threads 3. The ground threads 3 are deflected via a deflection beam 10 and the deflection element 4*d* and are supplied continuously to the cloth 7 travelling through the ground thread needle eye 4*b* and between the lamellae 6*a*of the reed. The ground thread needle bar 4 can be arranged stationary or movably mounted in the direction of movement 4*c*. The leno thread displacing apparatus 5 is mounted so as to be displaceable in the vertical direction 5*f* and comprises a laying element 5*a* with guiding means 5*p* for guiding the leno thread 2. The laying element 5*a* is displaceably mounted in a displacement direction 5*b* which extends in the direction of the cloth width, i.e. in the direction of extent of the reed 6 respectively. In the illustrated exemplary embodiment the leno thread displacing apparatus 5 has a second laying element 5*c* which is arranged spaced apart in the direction of extent of the leno thread 2 and two vertical guides 5*d*, 5*e* which form a gap and between which the leno thread 2 extends. One or more leno threads or ground threads 2, 3 can each be arranged to extend through each ground thread needle eye 4*b* and/or through each guiding means 5*p* respectively. The ground threads 2 and leno threads 3 can also be arranged in such a manner that only one single thread extends in each eye 4*b* or in each guiding means 5*p* respectively. When the ground thread needle bar 4 is stationary the position of the ground thread 3 is predetermined, with the position of the leno thread 2 being cyclically moved through the movement of the leno thread displacing apparatus 5 in the vertical direction 5*f* into a leno thread in the high position 2H as well as into a leno thread in the low position 2T. The movement of the leno thread displacing apparatus 5 is coordinated in such a manner that, due to the movement in the displacement direction 5*f* and the movement 5*b* in the direction of extent of the reed 6, the leno thread 2 is alternately laid in between two different intermediate spaces which are formed by the ground thread needles 4*a*, in that the combined movement 5*g* is carried out.

Figure 2:
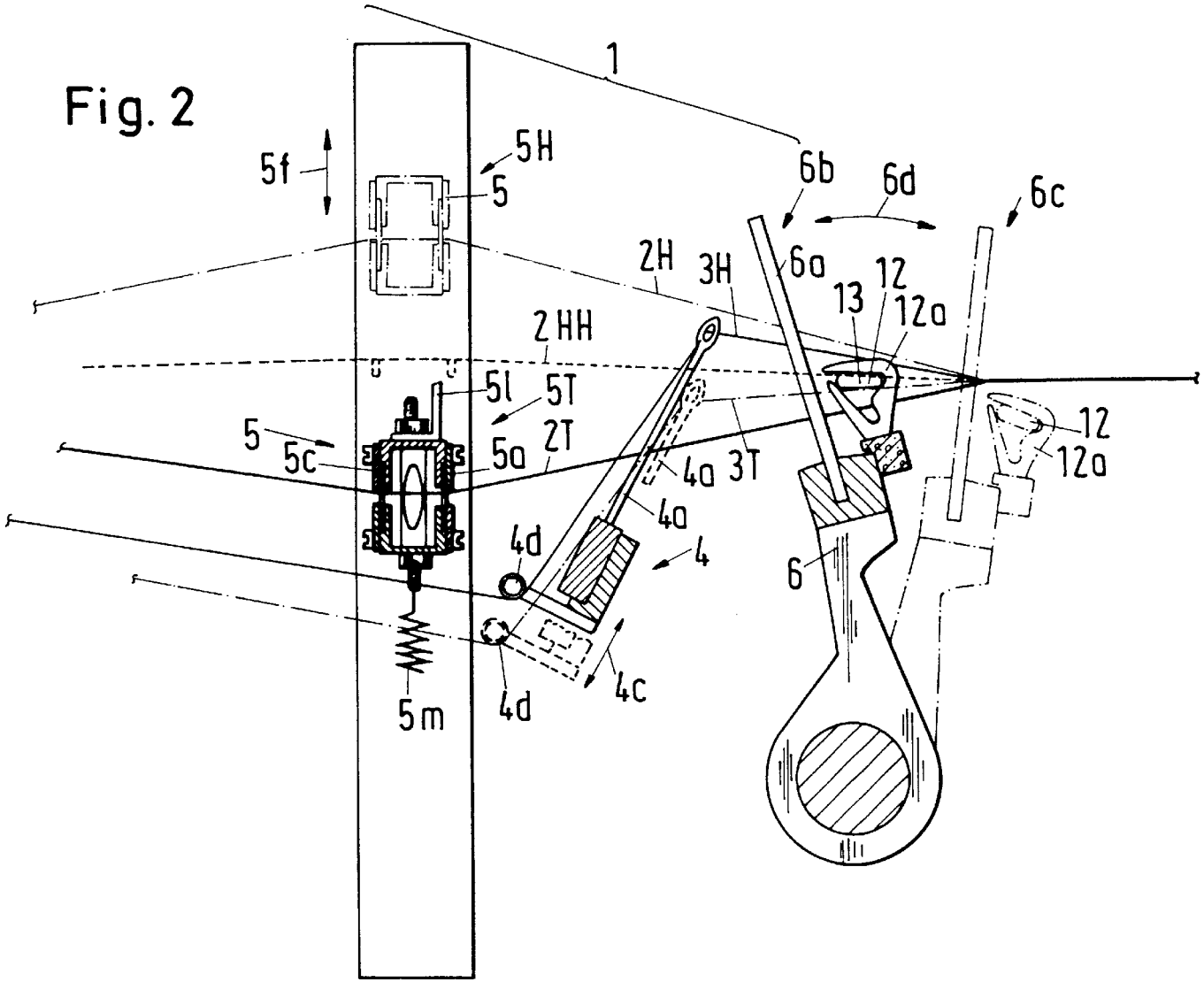
FIG. 2 is a side view of the apparatus for forming a leno edge in combination with a projectile weaving machine.

FIG. 2 shows a side view of the apparatus 1 for forming a leno edge. The leno thread displacing apparatus 5 is at first in a low position 5T, so that the leno thread 2T is held in the low position. The ground thread needle bar 4 is arranged stationary in the first embodiment and holds the ground thread 3H in the high position, so that a shed is formed between the leno thread 2T and the ground thread 3H into which a projectile which inserts a weft thread 13 can be introduced which is guided by a projectile guiding apparatus 12*a*. Then the reed 6 with lamella 6*a* is beat up against the cloth edge in the direction of movement 6*d* so that the reed is in the beat-up position 6*c*. After the completion of the beating up the reed 6 is again brought back into the open position 6*b* travelling in the direction of movement 6*d*. During the beating up of the reed 6 and the succeeding moving into the open position 6*b* the leno thread displacing apparatus 5 executes a rerouting movement in which the leno thread displacing apparatus 5 is lifted up vertically in the direction of movement 5*f* and is brought into the high position 5H, with the laying element 5*a* also being displaced in the displacement direction 5*b* and with the leno thread displacing apparatus 5 then again being displaced in the vertical direction 5*f* into the low position 5T, so that the leno thread 2, which is at first in the low position 2T, is lifted up into the high position 2H and is then transferred again into a low position 2T into a different intermediate space between two ground thread needles 4*a*. Thus the leno thread 2T and the ground thread 3H again form an open shed into which a weft thread 13 can be inserted.

In a second embodiment the ground thread needle bar 4, as is illustrated in broken lines in FIG. 2, is also displaceably mounted in the direction of movement 4*c*. In this the ground thread needle bar 4 is transferred after a completed weft insertion from the upper position into the lower position, which is illustrated in chain-dotted lines. And the leno thread displacing apparatus 5 is lifted up in the vertical direction 5*f* until the leno thread 2T comes to lie higher in the vertical direction than the ground thread needles 4*a*, as is illustrated by the leno thread 2HH, which is illustrated with a broken line. In contrast to the above-described arrangement, the leno thread displacing apparatus 5 need in this case travel only about one-half the vertical distance, so that the displaceably mounted ground thread needle bar 4 has the advantage that a new shed can be produced with a smaller movement of the leno thread displacing apparatus 5, which for example permits a more rapid weaving.

Figure 3A:
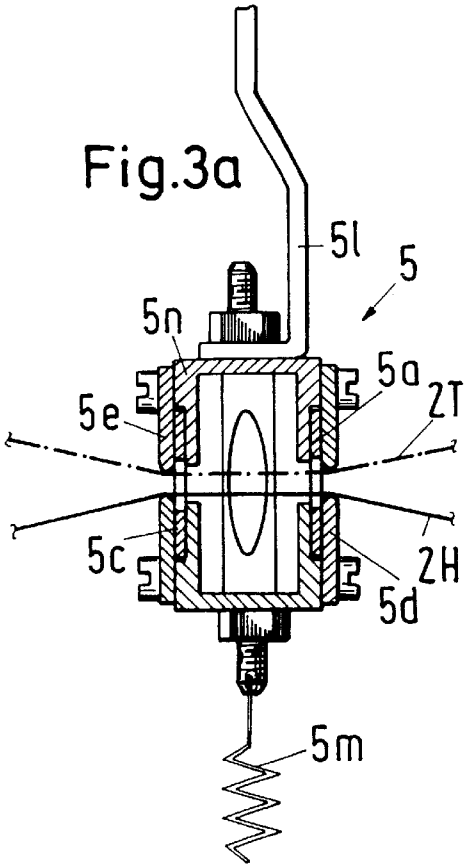
FIG. 3*a* is a section in the vertical direction through the leno thread displacing apparatus.
Figure 3B:
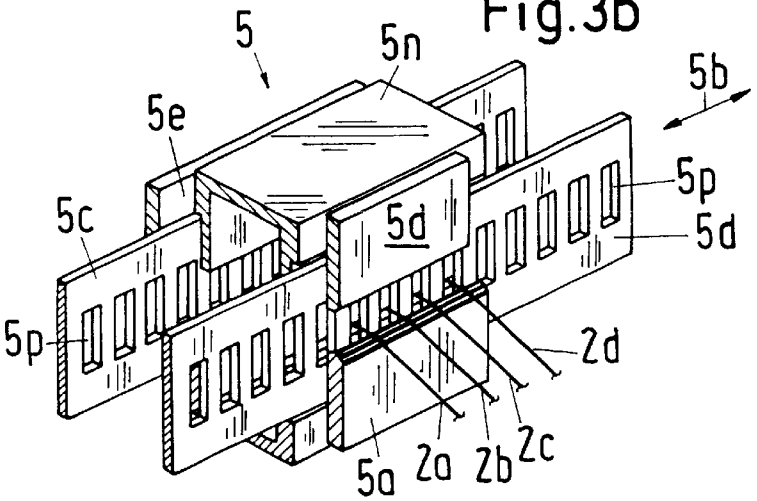
FIG. 3*b* is a perspective view of a partial section of the leno thread displacing apparatus.
Figure 4:
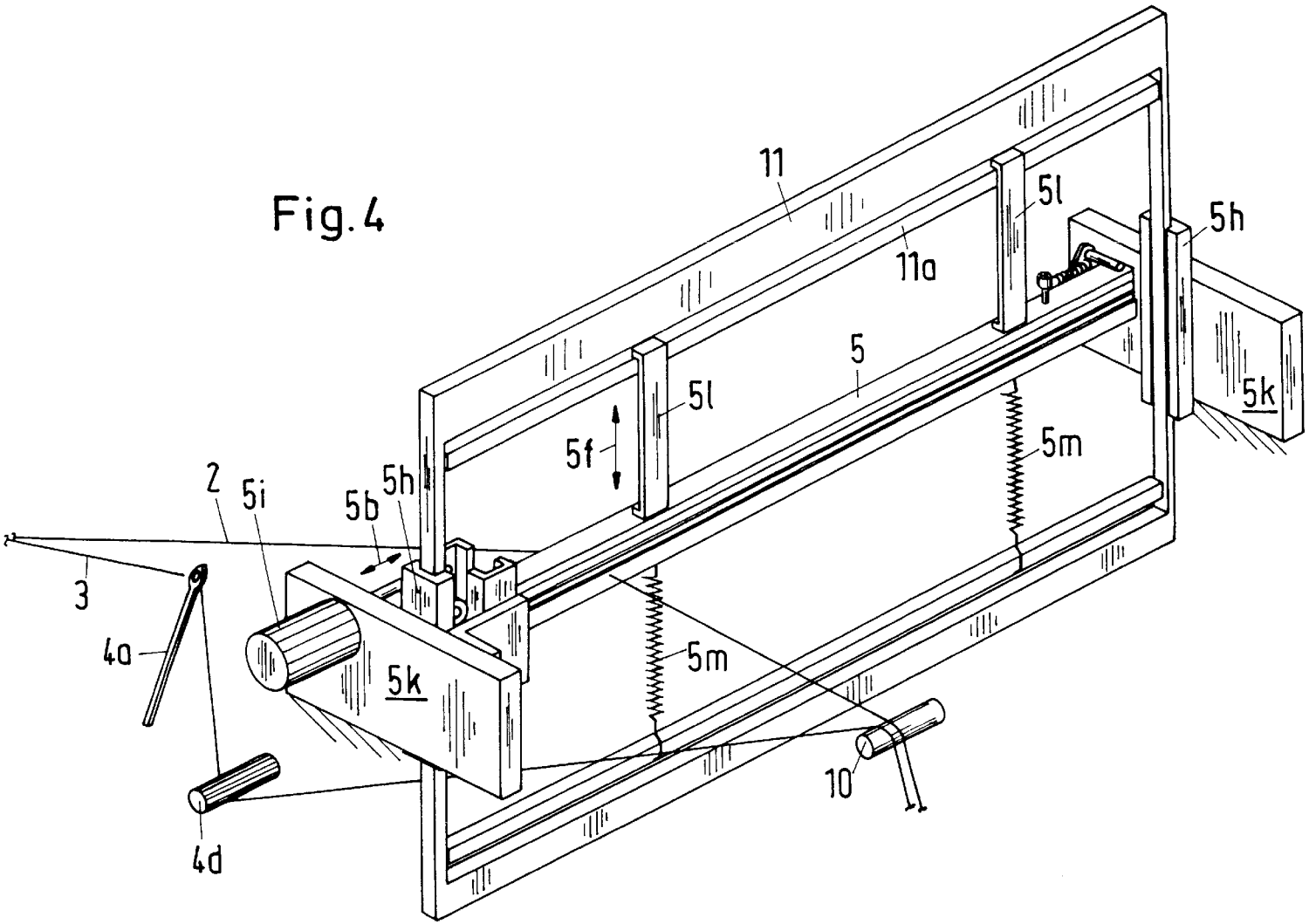
FIG. 4 is a perspective view of the leno thread displacing apparatus which is arranged in a heald frame.

FIG. 4 shows a heald frame 11 which is mounted by a fixedly arranged holder 5*k* with vertical lateral guidance 5*h* so that it is displaceable in the vertical direction 5*f*. The leno thread displacing apparatus 5 is suspended at the top at the frame 11 via a holder 51 and is connected to the frame 11 via springs 5*m* at the bottom. In addition, a drive 5*i* is arranged at the fixedly arranged holder 5*k* and is connected, for example via displacement elements such as levers or draw cables, to the longitudinally displaceable laying element 5*a* of the leno thread displacing apparatus 5 in order to move the laying element 5*a* in the direction of movement 5*b* in a controlled manner. The cross-section through the leno thread displacing apparatus 5 which is illustrated in FIG. 3*a* shows a base body 5*n* which is firmly connected at the top to a holder 51 and which is connected at the bottom to a spring 5*m*. At both sides the base body 5*n* forms, together with the guides 5*d*, 5*e*, a vertically extending gap, in each of which a longitudinal rail 5*a*, 5*c* is arranged. At least the laying rail 5*a* is displaceable in the direction of movement 5*b* and is mounted so as to be drivable by the drive 5*i*. On the one hand, the path of the leno thread 2 in a high position 2H as well as in a low position 2T are illustrated. The perspective view which is illustrated in FIG. 3*b* shows a part of the leno thread displacing or shifting device 5 with the base body 5*n* as well as the vertical guide which consists of two part elements 5*d*, 5*e* which form a slit extending in the direction of extent of the cloth width and in the horizontal direction. The longitudinal rail 5*a*, which is displaceable in the direction of movement 5*b*, has regularly spaced-apart apertures 5*p*, which are made rectangular in the illustrated exemplary embodiment and which are mutually spaced apart in such a manner that adjacently arranged leno threads 2*a*, 2*b*, 2*c*, 2*d* are individually guided and displaceably mounted in the direction of movement 5*b*. The leno threads 2*a*, 2*b*, 2*c*, 2*d* each extend individually through an aperture 5*p* of the stationary laying rail 5*c*.

Figure 3C:
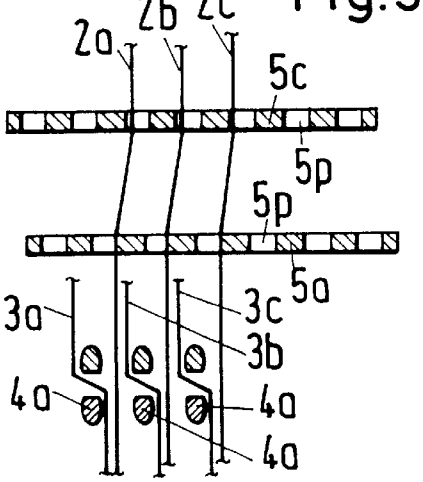
FIGS. 3*c*, 3*d* illustrate laying elements of the leno thread displacing apparatus in different positions.
Figure 3D:
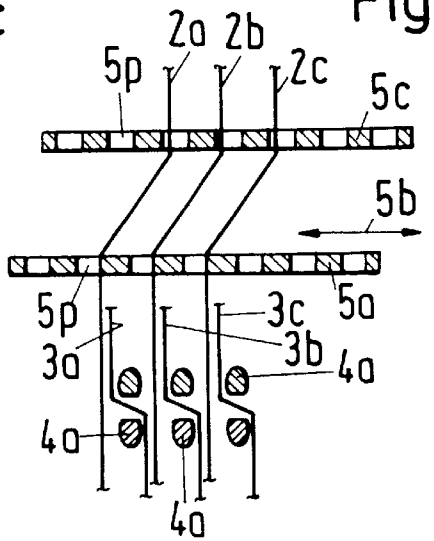

FIGS. 3*c* and 3*d* show the rerouting of the leno threads 2*a*, 2*b*, 2*c* which is effected by the leno thread displacing apparatus 5 into adjacently arranged intermediate spaces of the ground thread needles 4*a*. Starting from the basic position in accordance with FIG. 3 the longitudinally displaceable laying element 5*a* is displaced to the left and then lowered in the vertical direction in the arrangement in accordance with FIG. 3*d* in such a manner that the leno threads 2*a*, 2*b*, 2*c* are in each case lowered between the ground thread needles 4*a* and shifted to the left by one of the latter. In the next step the leno thread displacing apparatus 5 is again lifted in the vertical direction, and the longitudinally displaceable laying element 5*a* is displaced to the right and is again lowered in the vertical direction, so that the leno threads 2*a*, 2*b*, 2*c* again come to lie in the basic position between the ground thread needles 4*a* which is illustrated in FIG. 3*c*. As can be seen in FIG. 3*c*, the laying rails 5*a*, 5*c* are arranged in the basic position to be slightly shifted in the displacement direction 5*b* so that the leno threads 2*a*, 2*b*, 2*c* have a slight shift in their direction of extent and they thereby lie in contact at the side wall of the aperture 5*p*, which makes it possible for the leno threads 2*a*, 2*b*, 2*c* to be particularly reliably guided and positioned.

Figure 3E:
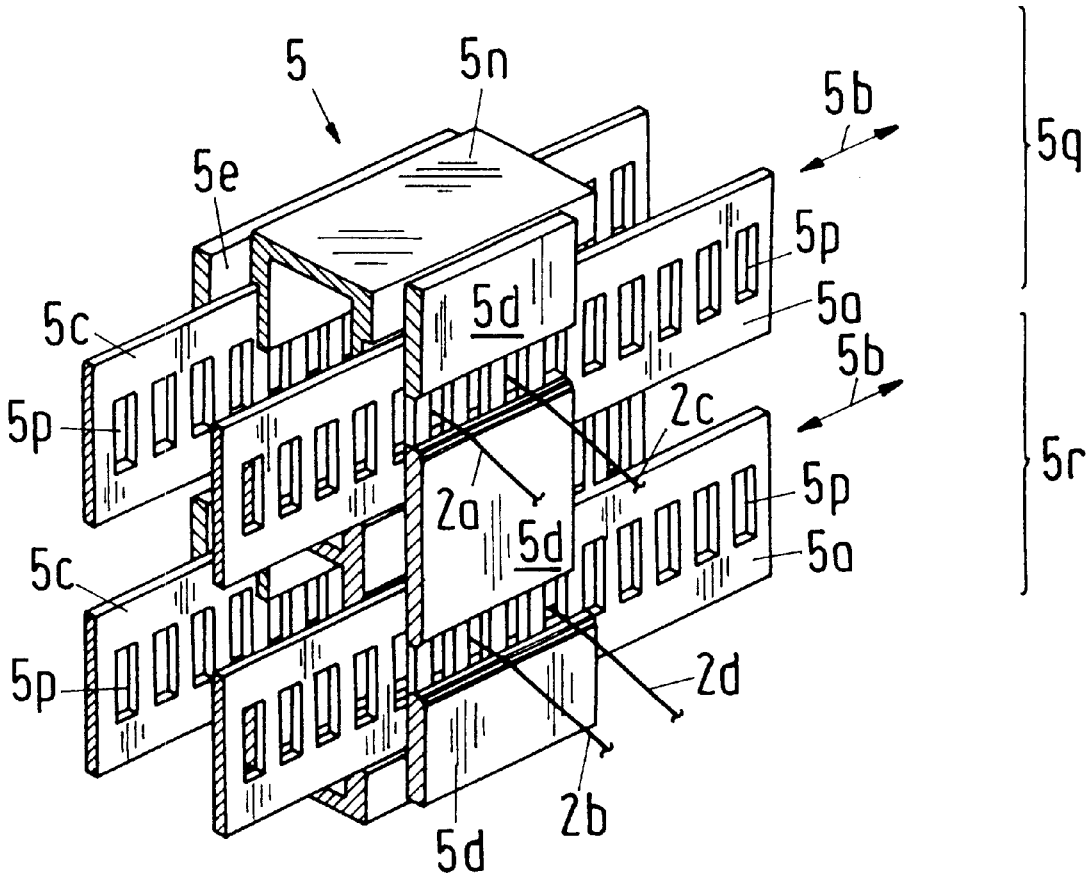
FIG. 3*e* is a leno thread displacing apparatus with two laying rails which are movable independently of one another.
Figure 5A:
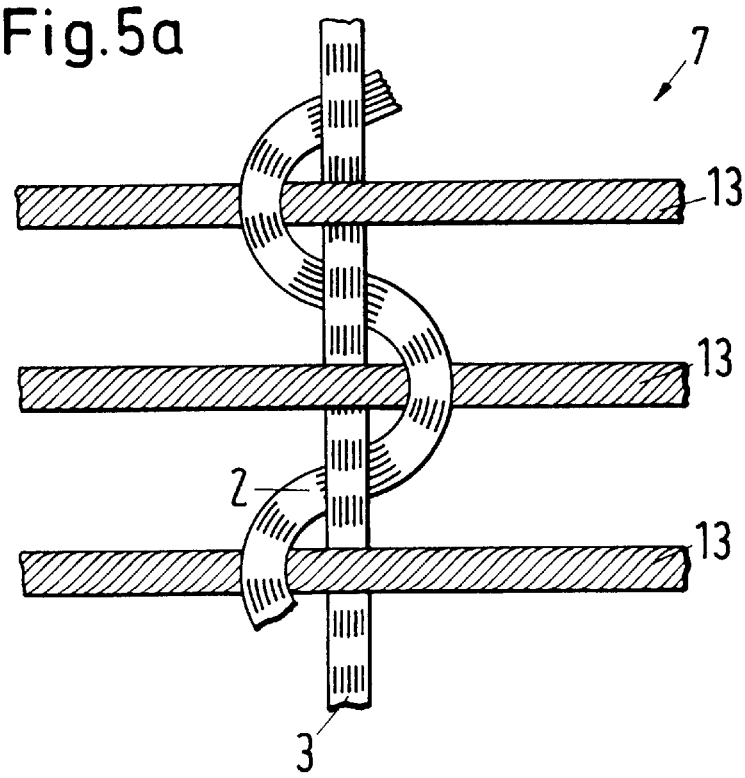
FIGS. 5*a*, 5*b*, 5*c* are views of woven leno weaves.
Figure 5B:
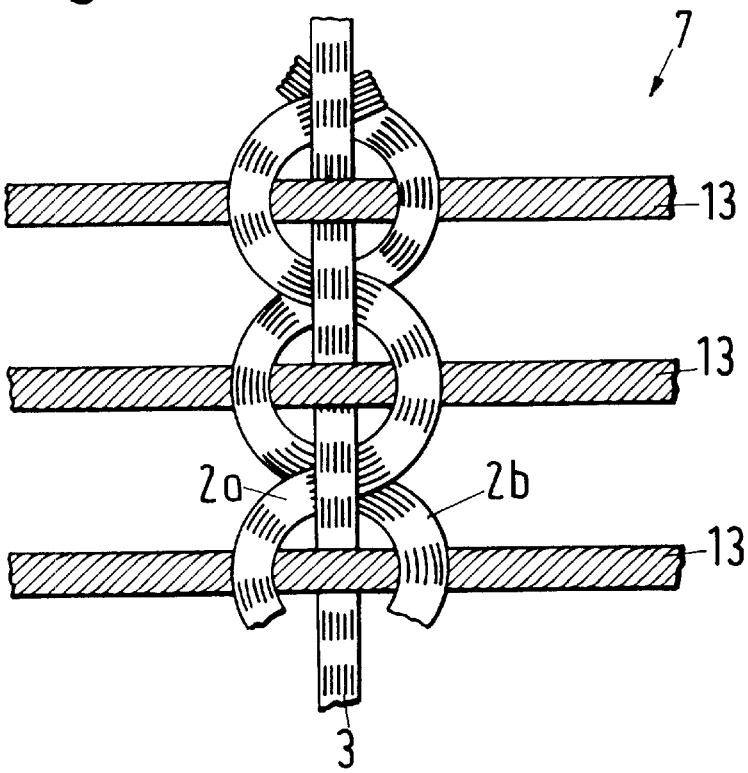
Figure 5C:
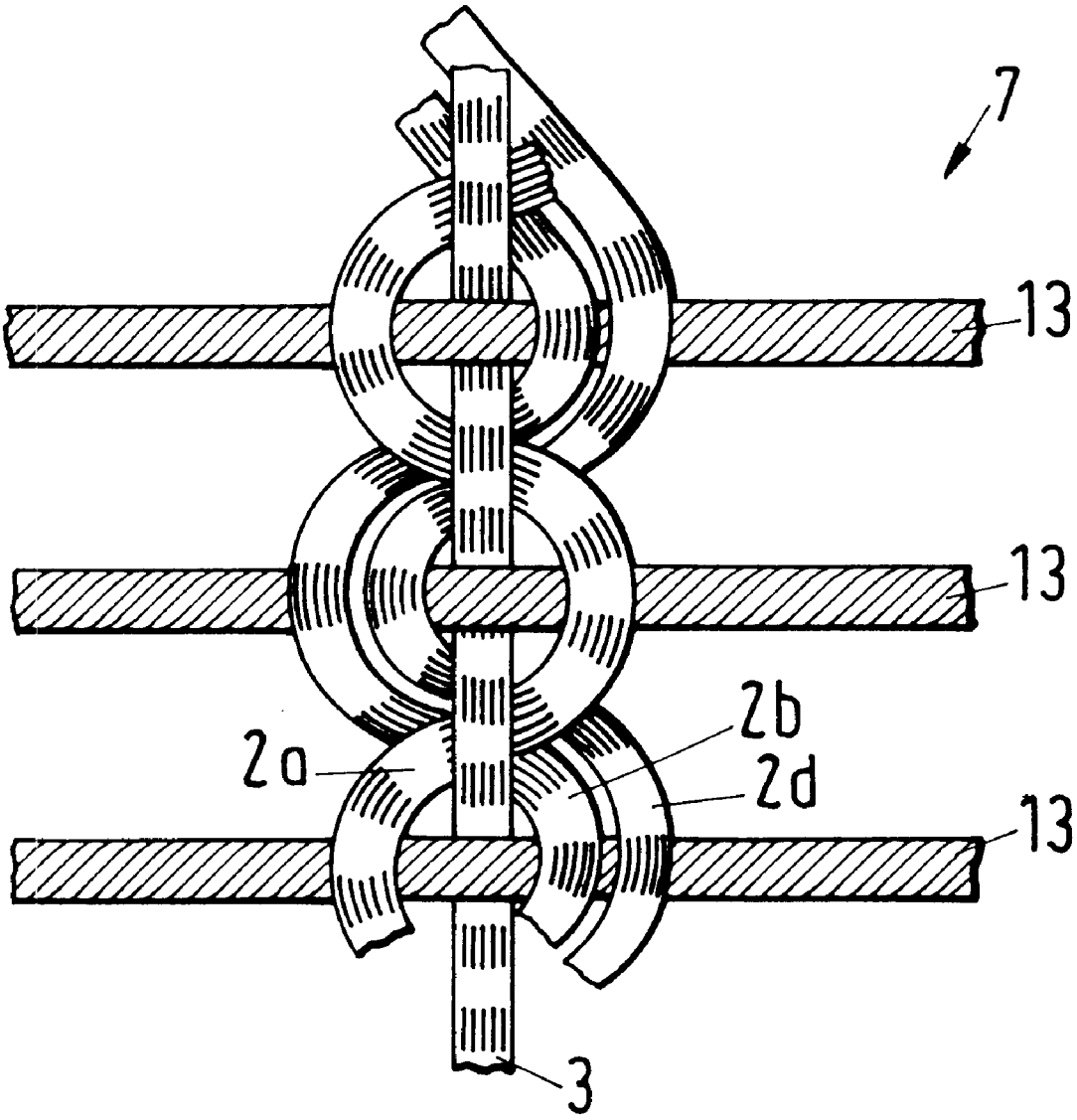

FIG. 3*e* shows a further exemplary embodiment of a leno thread displacing apparatus 5 consisting of two parts 5*q*, 5*r*, with each part 5*q*, 5*r* being designed as is illustrated in the exemplary embodiment in accordance with FIG. 3*b*. The two parts 5*q*, 5*r* are firmly connected to one another. The leno thread displacing apparatus 5 which is illustrated in FIG. 3*e* thus has two laying rails 5*a* which are longitudinally displaceable independently of one another, with the leno threads 2*a*, 2*c* being displaceably mounted in the first part 5*q* and the leno threads 2*b*, 2*d* being displaceably mounted in the second part 5*r*. Because the leno threads 2*a*, 2*c* and the leno threads 2*b*, 2*d* are mounted so as to be displaceable independently of one another in the direction of movement 5*b*, leno weaves can be produced in a large number of binding types, as is illustrated in FIGS. 5*a*, 5*b* and 5*c*. The leno thread displacing apparatus 5 could also comprise even more parts 5*q*, 5*r* and could for example consist of four parts which are arranged one above the other. The leno thread displacing apparatus 5 could also comprise a plurality of the devices which are illustrated in FIG. 3, with each of these devices being held and guided in a separate frame.

FIG. 5*a* shows sections of two warp threads 2, 3 of the cloth 7 which are woven in with the apparatus in accordance with the invention in the form of a leno weave comprising the ground thread 3, the leno thread 2 and weft threads 13. FIG. 5*a* shows a view from below onto the cloth 7. The apparatus in accordance with the invention permits manufacturing a cloth 7 containing at least one leno weave. It also permits partial widths of the cloth 7 or even the entire width of the cloth 7 to be produced exclusively of leno weaves.

FIG. 5*b* shows sections of three warp threads 2*a*, 2*b*, 3 of a cloth 7 which were woven in with the apparatus 5 which is illustrated in FIG. 3*e*. FIG. 5*c* shows sections of four warp threads 2*a*, 2*b*, 2*d*, 3 of a cloth 7 which were likewise woven in with the apparatus 5 which is illustrated in FIG. 3*e*. Through a corresponding arrangement of the warp threads 2*a*, 2*b*, 2*c*, 2*d* into the leno thread displacing apparatus 5 which is illustrated in FIG. 3*e*, cloths 7 with the most diverse of leno threads can be made. Thus the cloth 7 could for example have leno warp threads which are arranged to lie adjacent to one another and to have one each of a weave in accordance with FIG. 5*b* and a weave in accordance with FIG. 5*c*.

In a further exemplary embodiment, in a modification of the embodiment which is illustrated in FIG. 1, the leno thread displacing apparatus 5 could be arranged at the bottom in its basic position and the ground thread needle bar 4 could be arranged at the top, which means that they could be arranged in a mirror image with respect to the embodiment in accordance with FIG. 1, so that the leno thread 2 is lifted by the leno thread displacing apparatus 5 in order to lower it into the intermediate space which is formed by two ground thread needles 4*a*.

The exemplary embodiments show the leno thread displacing apparatus 5 to be mounted so as to be displaceable in a vertically or substantially vertically extending direction. The leno thread displacing apparatus could however also be mounted so as to be moveable in a different direction, which extends transverse to the displacement direction 5*b*, i.e. to the direction of extent of the reed 6.

What is claimed is:

1. Apparatus for forming a leno weave from a leno thread and a ground thread, the apparatus comprising a reed for guiding the leno thread and the ground thread, a needle bar including ground thread needles for guiding the ground thread and including a movably mounted leno thread displacing apparatus, wherein the needle bar and the leno thread displacing apparatus are arranged ahead of the reed, wherein the leno thread displacing apparatus comprises a laying element that is displaceably mounted in a first displacement direction that extends substantially parallel to the direction of extent of the reed in order to move the leno thread in the first displacement direction, wherein the laying element has guiding means for guiding the leno thread, wherein the leno thread displacing apparatus is movably mounted in a direction of movement that extends transversely to the direction of extent of the reed in order to move the leno thread in the direction of movement, wherein the needle bar is movably mounted in a second displacement direction, and wherein the second displacement direction extends in one of the vertical direction or in a direction that is inclined relative to the vertical direction in a direction towards the reed.

2. Apparatus in accordance with claim 1, wherein the leno thread displacing apparatus is movably mounted in a direction of movement that extends substantially vertically.

3. Apparatus in accordance with claim 1, wherein the laying element is configured as a laying rail, including a plurality of guiding means that are arranged with spacing in the displacement direction.

4. Apparatus in accordance with claim 3, wherein the guiding means are configured as apertures.

5. Apparatus in accordance with claim 4, wherein the apertures are rectangular apertures.

6. Apparatus in accordance with claim 1, wherein the leno thread displacing apparatus is connected to a heald frame.

7. Apparatus in accordance with claim 1, wherein the leno thread displacing apparatus includes two laying elements that are arranged spaced apart in the direction of extent of the leno thread, and wherein the laying element that is arranged in the direction towards the reed is displaceably mounted.

8. Apparatus in accordance with claim 1, wherein the leno thread displacing apparatus includes a guide that is placed behind the laying element when viewed from the reed and that forms a gap that extends in the first displacement direction.

9. Apparatus in accordance with claim 1, wherein the leno thread displacing apparatus includes a guide that is placed ahead of the laying element in the direction towards the reed and that forms a gap that extends in the displacement direction.

10. Apparatus in accordance with claim 1, wherein the ground needle bar includes ground thread needles that are distributedly arranged over an entire cloth width, and wherein the laying element includes guiding means that are arranged distributed over the entire cloth width.

11. Apparatus in accordance with claim 10, wherein a plurality of ground thread needles and guiding means are provided such that the cloth to be woven may be manufactured such that the cloth consists exclusively of a leno weave over at least a portion of the cloth width.

12. Apparatus in accordance with claim 1, wherein the leno thread displacing apparatus comprises at least two laying elements that are displaceably mounted independently of one another in the displacement direction.

13. A weaving machine comprising an apparatus for forming a leno weave, wherein the apparatus comprises a reed for guiding the leno thread and the ground thread, a needle bar including ground thread needles for guiding the ground thread and including a movably mounted leno thread displacing apparatus, wherein the needle bar and the leno thread displacing apparatus are arranged ahead of the reed, wherein the leno thread displacing apparatus comprises a laying element that is displaceably mounted in a first displacement direction that extends substantially parallel to the direction of extent of the reed in order to move the leno thread in the first displacement direction, wherein the laying element has guiding means for guiding the leno thread, wherein the leno thread displacing apparatus is movably mounted in a direction of movement that extends transversely to the direction of extent of the reed in order to move the leno thread in the direction of movement, wherein the needle bar is movably mounted in a second displacement direction, and wherein the second displacement direction extends one of the vertical direction or in a direction that is inclined relative to the vertical direction in a direction towards the reed.

* * * * *